United States Patent [19]

Yeager et al.

[11] 4,400,105

[45] Aug. 23, 1983

[54] COMPUTER PRINTER PAPER TRACTOR MOUNTING MEANS

[75] Inventors: Thomas C. Yeager, St. Joseph; Douglas E. Wood, Benton Harbor; Wayne J. Kooy, Galien, all of Mich.

[73] Assignee: Printck, Inc., Benton Harbor, Mich.

[21] Appl. No.: 311,948

[22] Filed: Oct. 16, 1981

[51] Int. Cl.[3] ..... B41J 11/30

[52] U.S. Cl. ..... 400/616.1; 226/74; 226/79; 400/692

[58] Field of Search ..... 400/616, 616.1, 616.2, 400/616.3, 692; 226/74, 75, 76, 77, 78, 79, 80, 81, 82, 83, 84, 85, 86, 87

[56] References Cited

U.S. PATENT DOCUMENTS 3,687,347 8/1972 Rod et al. ..... 226/74
4,115,014 9/1978 Wood et al. ..... 400/616.2 X
4,197,969 4/1980 Sasaki ..... 226/79
4,345,708 8/1982 Hubbard ..... 226/74

*Primary Examiner*—Ernest T. Wright, Jr.
*Attorney, Agent, or Firm*—Leydig, Voit, Osann, Mayer & Holt

[57] ABSTRACT

A device for mounting a paper tractor assembly between the side frames of a computer printer which allows the entire paper tractor assembly to be "popped out" by the application of finger pressure alone, and which eliminates the cost of rounding the ends of the square drive rod of the paper tractor assembly. The mounting device consists of mounting brackets to secure the rods of the paper tractor assembly, bushings to engage the ends of the square drive rod and adapt them to fit into the mounting brackets, and springs or other resilient means to allow the paper tractor assembly to be "popped out."

6 Claims, 4 Drawing Figures

COMPUTER PRINTER PAPER TRACTOR MOUNTING MEANS

BACKGROUND OF THE INVENTION

The present invention relates to computer printers and particularly to a device for mounting a paper tractor assembly on the printer frame.

In a computer printer, paper is pulled by means of a pair of paper tractors from a supply across a platen where characters are printed. The paper is conventionally a continuous, folded sheet having rows of spaced holes along its margins. Each paper tractor has a toothed sprocket wheel (or belt) that engages the spaced holes in the paper so that as the sprocket wheel is incrementally rotated, the paper is indexed, line by line, across the platen.

Each paper tractor is mounted on a circular support rod extending across the width of the platen and secured at each end to the sides of the printer frame. The paper tractors are slidably mounted on the support rod so that they can be moved from side to side to accommodate different widths of paper and different marginal spacings.

A square drive rod extends parallel to the support rod so that it can slidably engage a square hole in the sprocket wheel of each paper tractor and thus provides a mechanical drive means for any position of the paper tractors along the width of the platen. In conventional practice the drive rod is rounded at its ends in order to be journalled into the sides of the printer frame. Suitable drive gears are provided for the rotation of the drive rod.

Paper tractors in computer printers are items which have a high incidence of failure and are subject to frequent repair or replacement. As a result, it is important that they be easily removed and replaced without significant dismantling of the computer printer paper tractor assembly or the printer itself.

Furthermore, in terms of manufacturing the paper tractor assembly, it is undesirable to have to round off the square ends of the drive rod in order to accommodate those ends to a bearing mounted in the frame of the computer printer.

SUMMARY OF THE INVENTION

As a result, it is an object of the present invention to provide an insert for each end of the paper tractor assembly to secure the support rod and the drive rod to the computer printer frame so that the paper tractor assembly can be readily "popped out" of the computer frame to allow easy removal and replacement of the paper tractors.

It is a further object of the present invention to provide a paper tractor assembly mounting device that can accommodate a square drive shaft and provide a bearing assembly at either end of the drive shaft so that the drive shaft will not have to be ground during its manufacture.

Other objects and advantages of the invention will become apparent upon reading the following detailed description and upon reference to the drawing.

DETAILED DESCRIPTION OF THE INVENTION

Figure 1:
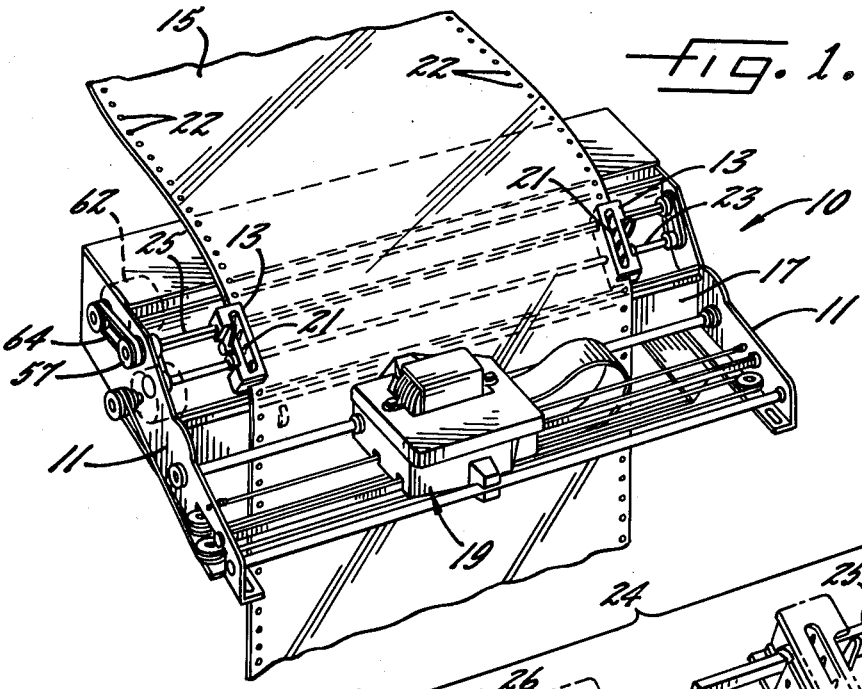
FIG. 1 is a perspective view of a computer printer showing paper being pulled across the platen by a pair of paper tractors.

Turning first to FIG. 1, there is shown a computer printer 10 loaded with paper 15 such that the paper 15 passes between a printer carriage 19 and a backing platen 17. The paper 15 is pulled across the platen 17 by a pair of paper tractors 13 each having a toothed sprocket wheel (or belt) 21 which engages spaced holes 22 along the margins of the paper 15. The paper 15 moves across the platen 17, one line at a time, as the sprocket wheel 21 is indexed.

Figure 2:
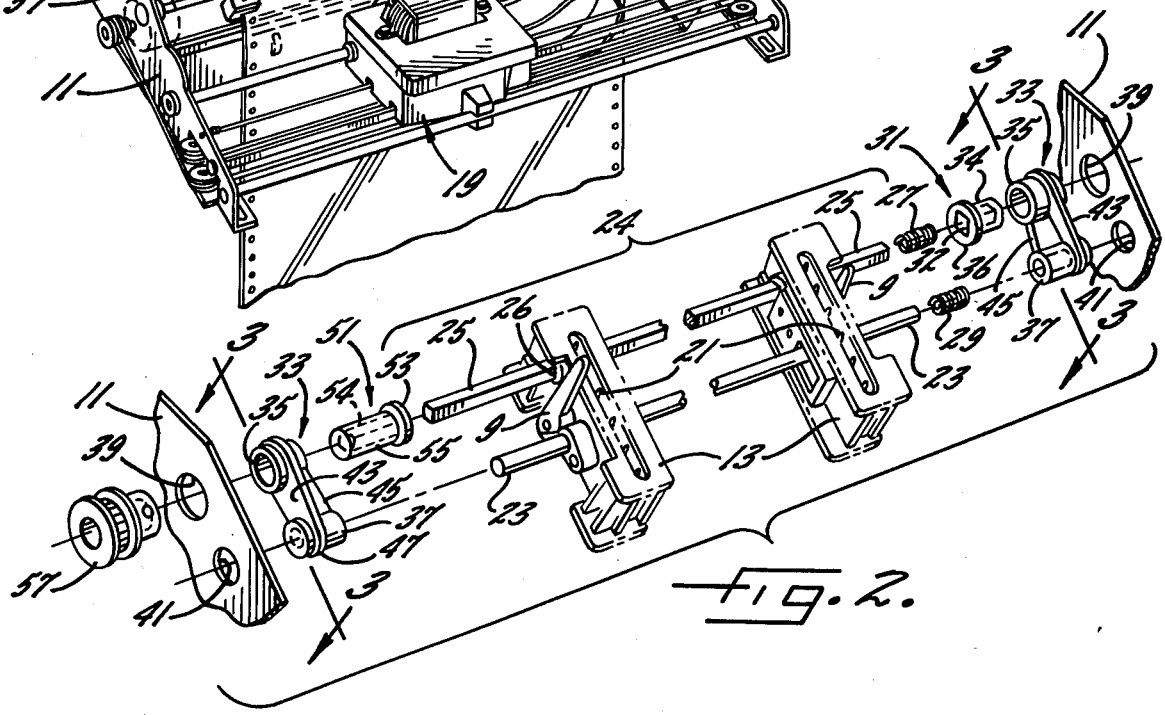
FIG. 2 is an exploded view of the paper tractor assembly and mounting means constructed in accordance with the invention.

It can be seen in FIG. 2 that the paper tractors 13 are mounted by means of conventional clamping mechanisms 9 on a circular support rod 23 passing through them. A square drive rod 25, parallel to support rod 23, passes through and engages a square hole 26 in the sprocket wheel 21 of each paper tractor 13. The paper tractors 13 are slidably mounted on both rods 23, 25 so they can be moved laterally to accommodate various widths of paper 15. The square drive rod 25, which is driven by means of motor 62, belt 64 and drive pulley 57, provides mechanical drive for incrementally advancing the paper 15 across the platen 17.

The paper tractor assembly 24—that is, the paper tractors 13 mounted on the circular support rod 23 and the square drive rod 25—is insertably mounted in accordance with the invention between the printer side frames 11, each of which has a pair of paper tractor assembly mounting holes 39, 41. The mounting device consists essentially of mounting brackets 33 which secure the rods 23, 25 of the paper tractor assembly 24 relative to the printer side frames 11, closed end bushings 31, 51 which engage the ends of the square drive rod 25 and adapt said ends to fit into the mounting brackets 33, and springs 27, 29 or other resilient means.

Figure 4:
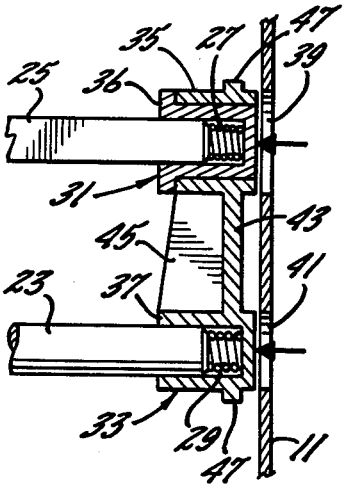
FIG. 4 shows the right hand portion of FIG. 3 with the paper tractor assembly mounting means in its compressed position.

In order to mount the paper tractor assembly 24 so that it can be "popped out" of the mounting holes 39, 41 in the side frame 11, the right and left ends of the square drive rod 25 are respectively inserted into the right and left bushings 31, 51. A spring 27, or other resilient means, is placed inside the right-bushing 31 as a means for compressing the paper tractor assembly 24 and mounting means in order to achieve the "pop out" feature of this invention. A second spring 29, or other resilient means, is placed against the right-hand end of the circular support rod 23 for the same purpose. Mounting brackets 33 are placed between the printer side frames 11 and the paper tractor assembly 24 which now is associated with bushings 31, 51 and resilient means 27, 29. The paper tractor assembly 24 is "popped out" of the printer 10 merely by pressing through the right-hand mounting holes 39, 41 against the bracket 33 to compress the springs 27, 29 (FIG. 4).

More specifically, the right end of the square drive rod 25 is inserted into right-bushing 31 which is closed at one end and which contains an integral square opening 32 for engaging the square drive rod 25. A light spring 27, or other resilient means, is placed between the rod 25 and the right-bushing 31 to hold them in place when the paper tractor assembly 24 is mounted between the printer side frames 11. The cylindrical stem 34 of the right-bushing 31 is inserted through the bearing 35 in the upper portion of the mounting bracket 33 so that the lip 36 of the right-bushing 31 abuts the left-hand edge of the bearing 35 and the right-hand edge of the right-bushing 31 is flush with the right-hand end of the bearing 36. It is understood that the bearing 35 alternatively could be closed at its right-hand end to form a receptacle as found in the lower portion of the mounting bracket 33. Also, the right and left bushings 31, 51 can be replaced with alternative means of adapting the bearing 35 of the mounting bracket 33 to receive the square drive rod 25.

The right-hand end of the circular support rod 23 is inserted into a receptacle 37 in the lower portion of the mounting bracket 33. A stiff spring 29, or other resilient means, is placed between the circular support rod 23 and receptacle 37 to hold them in place when the paper tractor assembly 24 has been mounted between the printer side frames 11.

The mounting brackets 33 are comprised principally of the bearing 35 in the bracket's upper portion and the receptacle structure 37 in its lower portion. The bearing 35 and the receptacle 37 are connected by a plate 43 which is parallel to to the printer side frame 11 and extends to form a lip 47 around the bearing 35 and receptacle 37. The plate 43 and the lip 47 act to hold the mounting bracket 33 and printer tractor assembly 24 against the printer side frame 11. Also in accordance with the invention, there may be a brace 45 which connects the bearing 35 with the receptacle 37 and which is positioned perpendicular to the plate 43. For additional durability and ease in manufacturing, the brace 45 may be connected to the plate 43.

Figure 3:
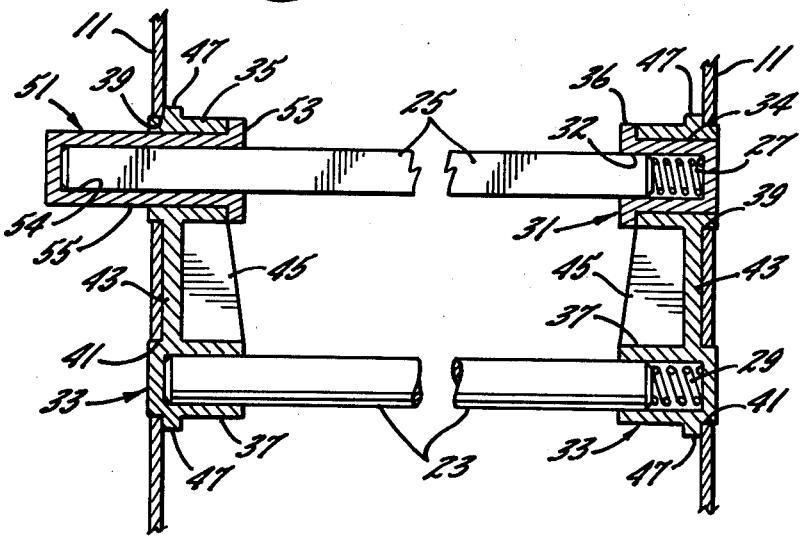
FIG. 3 is a sectional view of the paper tractor assembly mounting means looking at the plane in which lines 3—3 in FIG. 2 lie.

As shown in FIG. 3, the right mounting bracket 33 is positioned against the inside of the right-hand printer side frame 11 so that the right end of the bearing 35 fits into the upper paper tractor assembly mounting hole 39. The right end of the receptacle 37 of the mounting bracket 33 fits into the lower paper tractor assembly mounting hole 41.

The left-hand side of the paper tractor assembly 24 is mounted on the printer side frame 11 in a similar manner. The left-hand end of the square drive rod 25 is inserted into the left-bushing 51. Said bushing 51 is closed at one end and has integral square opening 54 for engaging the square drive rod 25. The cylindrical stem 55 of the left-bushing 51 must be sufficiently long so that it passes entirely through both the bearing 35 in the upper portion of the mounting bracket 33 and the upper paper tractor assembly mounting hole 39 to provide for connecting the drive pulley 57 to the stem 55.

FIG. 3 shows the left mounting bracket 33 positioned against the inside of the left printer side frame 11 so that the left-hand end of the bearing 35 fits into the upper paper tractor assembly mounting hole 39 with the stem 55 of the left-bushing 51 extending past the printer side frame 11 as described above. When the paper tractor assembly 24 is mounted between the printer side frames 11, the lip 53 of the left-bushing 51 abuts the right-hand edge of the bearing 35 of the mounting bracket 33. The left-hand end of the circular support rod 23 is inserted into a receptacle 37 in the lower portion of the mounting bracket 33. The left-hand end of the receptacle 37 of the mounting bracket 33 fits into the lower paper tractor assembly mounting hole 41.

By pressing through the right-hand upper and lower paper tractor assembly mounting holes 39, 41, the springs 27, 29 are compressed (shown by arrows in FIG. 4) and the mounting bracket 33 and paper tractor assembly 24 easily can be "popped out" for removal and replacement of the paper tractors 13.

Thus it is apparent that there has been provided, in accordance with the invention, a means for mounting the paper tractor assembly between the side frames of a computer printer in such a manner that the paper tractor assembly "pops out" for easy removal and replacement. Moreover, the need to round off the square ends of the drive rod has been eliminated. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as may be included within the spirit and broad scope of the appended claims.

What is claimed is:

1. In a computer printer having opposed side frame with mounting holes therein, a paper tractor mounting assembly comprising, in combination, a square drive rod and circular support rod, each rod having a first and second end; first and second mounting brackets received in the mounting holes on the inside surfaces of the side frames, each mounting bracket configured on one side for being received in the mounting holes of the respective side frame and configured on the opposite side for receiving the ends of the drive and support rods; bushing means on the first and second ends of the drive rod interposed between the drive rod ends and the mounting brackets to allow rotation of the drive rod with respect to the mounting brackets; and resilient means interposed between the first ends of each of the drive rod and support rod and the first mounting bracket to hold the drive rod, support rod, and first and second mounting brackets in place with respect to the side frames while allowing for installation and removal of the mounting assembly by first compressing the resilient means with pressure applied to the first mounting bracket and then rotating the mounting assembly.

2. The paper tractor mounting assembly of claim 1 wherein the second end of the square drive rod and its corresponding bushing means extend through the second mounting bracket and its respective side frame to further engage a drive pulley.

3. The paper tractor mounting assembly of claim 1 wherein each mounting bracket comprises a bearing structure for receiving the bushing means on the first and second ends of the drive rod, a receptacle structure for receiving the first and second ends of the support rod, and a plate connecting said bearing and receptacle structures in a plane parallel to the plane of the printer side frame.

4. The mounting bracket of claim 3 wherein the plate extends around the bearing structure and the receptacle structure to form a lip.

5. The mounting bracket of claim 3 wherein the bearing structure and receptacle structure are connected by a brace perpendicular to the plate.

6. In a computer printer having opposed side frames and a paper tractor assembly with a square drive rod and circular support rod mounted therebetween, paper tractor assembly mounting means wherein the mounting means for one end of the drive rod and support rod comprises a mounting bracket configured on one side for being received in its respective side frame and configured on the opposite side for receiving the ends of the drive and support rods; bushing means on the end of the drive rod interposed between the drive rod and the mounting bracket to allow rotation of the drive rod with respect to the mounting bracket; and resilient means interposed between the ends of each of the drive rod and support rod and the mounting bracket to hold the drive rod, support rod and mounting bracket in place with respect to the side frames while allowing for installation and removal of the paper tractor assembly by first compressing the resilient means with pressure applied to the mounting bracket and then rotating the mounting means.

* * * * *

UNITED STATES PATENT AND TRADEMARK OFFICE

CERTIFICATE OF CORRECTION

PATENT NO. : 4,400,105

DATED : August 23, 1983

INVENTOR(S) : Thomas C. Yeager; Douglas E. Wood; & Wayne J. Kooy

It is certified that error appears in the above—identified patent and that said Letters Patent is hereby corrected as shown below:

On cover page, line [73] Assignee:, change "Printck" to --Printek--

Col. 3, line 9, cancel "bearing 36" and insert --bearing 35--

Signed and Sealed this

*Twenty-fifth* Day of *October 1983*

[SEAL]

*Attest:*

GERALD J. MOSSINGHOFF

*Attesting Officer*

*Commissioner of Patents and Trademarks*